US005444453A

United States Patent [19]

Lalezari

[11] Patent Number: 5,444,453

[45] Date of Patent: Aug. 22, 1995

[54] MICROSTRIP ANTENNA STRUCTURE HAVING AN AIR GAP AND METHOD OF CONSTRUCTING SAME

[75] Inventor: Farzin Lalezari, Louisville, Colo.

[73] Assignee: Ball Corporation, Muncie, Ind.

[21] Appl. No.: 267,173

[22] Filed: Jun. 28, 1994

Related U.S. Application Data

[63] Continuation of Ser. No. 12,301, Feb. 2, 1993, abandoned.

[51] Int. Cl.[6] ..... H01Q 1/38

[52] U.S. Cl. ..... 343/700 MS; 343/846; 343/848

[58] Field of Search ..... 343/700 MS, 829, 830, 343/845, 846, 848; H01Q 1/38, 1/48

[56] References Cited

U.S. PATENT DOCUMENTS

| | | | |
|---|---|---|---|
| 3,239,838 | 3/1966 | Kelleher | 343/789 |
| 4,131,894 | 12/1978 | Schiavone | 343/700 MS |
| 4,605,933 | 8/1986 | Butscher | 343/700 MS |
| 4,614,947 | 9/1986 | Rammos | 343/778 |
| 4,633,262 | 12/1986 | Traut | 343/700 MS |
| 4,697,189 | 9/1987 | Ness | 343/700 MS |
| 4,821,040 | 4/1989 | Johnson et al. | 343/700 MS |
| 4,827,276 | 5/1989 | Fukuzawa et al. | 343/778 |
| 4,835,541 | 5/1989 | Johnson et al. | 343/700 MS |
| 4,990,926 | 2/1991 | Otsuka et al. | 343/700 MS |
| 5,075,691 | 12/1991 | Garay et al. | 343/700 MS |
| 5,124,713 | 6/1992 | Mayes et al. | 343/700 MS |
| 5,181,044 | 1/1993 | Matsumoto et al. | 343/700 MS |

*Primary Examiner*—Donald Hajec
*Assistant Examiner*—Hoanganh Le
*Attorney, Agent, or Firm*—Gilbert E. Alberding

[57] ABSTRACT

A microstrip antenna structure comprising a radiator layer that includes a substrate layer and a radiator patch that is disposed on one surface of the substrate layer; a ground plane; and support elements, formed as an integral part of either the radiator layer or the ground plane, for maintaining a dielectric space between the radiator patch and the ground plane that includes an air gap of predetermined thickness between the substrate layer and the ground plane. The present invention also includes a method for constructing such a microstrip antenna structure.

30 Claims, 9 Drawing Sheets

MICROSTRIP ANTENNA STRUCTURE HAVING AN AIR GAP AND METHOD OF CONSTRUCTING SAME

This is a continuation of application Ser. No. 08/012,301, filed on Feb. 2, 1993, now abandoned.

BACKGROUND OF THE INVENTION

1. Field of the Invention

This invention relates to the structure of a microstrip antenna comprised of a radiator patch and feedline that are separated from a conductive ground plane by a space with a dielectric constant, hereinafter referred to as the dielectric space. More specifically, the invention relates to a microstrip antenna in which the dielectric space includes an air gap.

2. Description of the Related Art

The performance of an antenna is determined by several parameters, one of which is efficiency. For a microstrip antenna, "efficiency" is defined as the power radiated divided by the power received by the input to the antenna. A one-hundred percent efficient antenna has zero power loss between the received power input and the radiated power output. In the design and construction of microstrip antennas it is desirable to produce antennas having a relatively high efficiency rating, preferably in the range of 95 to 99 percent.

One factor in constructing a high efficiency microstrip antenna is minimizing power loss, which may be caused by several factors including dielectric loss. Dielectric loss is due to the imperfect behavior of bound charges, and exists whenever a dielectric material is located in a time varying electrical field. Moreover, because dielectric loss increases with operating frequency, the problem of dielectric loss is aggravated when operating at higher frequencies.

The extent of dielectric loss for a particular microstrip antenna is determined by, inter alia, the permittivity, $\epsilon$, expressed in units of farads/meter (F/m), of the dielectric space between the radiator and the ground plane which varies somewhat with the operating frequency of the antenna system. As a more convenient alternative to permittivity, the relative dielectric constant, $\epsilon_r$, of the dielectric space may be used. The relative dielectric constant is defined by the equation:

$$\epsilon_r = \epsilon / \epsilon_o \qquad \text{(i)}$$

where $\epsilon$ is the permittivity of the dielectric space and $\epsilon_o$ is the permittivity of free space ($8.854 \times 10^{-12}$ F/m). It is apparent from this equation that free space, or air for most purposes, has a relative dielectric constant approximately equal to unity.

A dielectric material having a relative dielectric constant close to one is considered a "good" dielectric material—that is, the dielectric material exhibits low dielectric loss at the operating frequency of interest. When a dielectric material having a relative dielectric constant equal to unity is used, dielectric loss is effectively eliminated. Therefore, one method for maintaining high efficiency in a microstrip antenna system involves the use of a material having a low relative dielectric constant in the dielectric space between the radiator patch and the ground plane.

Furthermore, the use of a material with a lower relative dielectric constant permits the use of wider transmission lines that, in turn, reduce conductor losses and further improve the efficiency of the microstrip antenna.

The use of a material with a low dielectric constant, however, is not without drawbacks. For example, one dielectric material frequently used in microstrip antenna systems is Teflon fiberglass which has a typical relative dielectric constant of ranging from 2.1 to 2.6 in the radio-frequency (RF) range. Because Teflon fiberglass is expensive, however, the resultant cost of such a high-efficiency antenna system is prohibitive for many applications. Moreover, using a substrate material with a dielectric constant even as low as 2.1 may still result in significant dielectric loss at high operating frequencies.

Another suggested method to produce low dielectric loss microstrip antenna systems involves the use of a material having a honeycomb core, such as that sold under the mark HEXCEL HRP, to separate the radiator patch from the ground plane. A honeycomb core substrate material can have a dielectric constant as low as 1.09 at high frequencies, thereby reducing dielectric loss. The construction of an antenna system using a honeycomb core, however, is disadvantageous for several reasons. For example, both the honeycomb material and the glue required to bond the honeycomb material to the antenna elements are expensive. Additionally, the construction of an antenna utilizing a honeycomb substrate is burdensome due to the need to form the honeycomb into a narrow thickness and then carefully glue the honeycomb securely between the antenna radiator patch and the ground plane. Using this method will produce inaccurate and inefficient antenna systems unless very careful control of tolerances, glue-line thickness, and materials is maintained. Moreover, it is very expensive and technically difficult, if not impossible, to form the honeycomb material into a sufficiently thin and uniform height as required for high operating frequencies. Consequently, the expense and labor-intensity of this method makes it prohibitively expensive and burdensome for many applications.

SUMMARY OF THE INVENTION

It is an object of the present invention to provide a microstrip antenna having low dielectric loss.

A further object of the present invention is to provide a microstrip antenna which utilizes an air gap in the dielectric space between the radiator patch and the ground plane to achieve low dielectric loss.

Another object of the present invention is to provide an inverted microstrip antenna with an air gap in the dielectric space between the radiator patch and the ground plane to reduce dielectric loss.

A further object of the present invention is to provide an inverted microstrip antenna in which only an air gap is present in the dielectric space between the radiator patch and the ground plane to achieve low dielectric loss.

Another object is to provide a relatively easy and inexpensive method of constructing a microstrip antenna having an air gap in the dielectric space between the radiator patch and the ground plane.

Yet another object is to provide a relatively easy and inexpensive method of constructing an inverted microstrip antenna having an air gap in the dielectric space between the radiator patch and the ground plane.

Several of the foregoing objects, among others, are achieved in one embodiment of the invention by a microstrip antenna structure comprising a radiator layer with an antenna radiator patch disposed on one face of a substrate; a ground plane that is separated from the layer; and a support means, formed as an integral part of either the ground plane or the radiator layer, for maintaining an air gap of predetermined thickness between the radiator patch and the ground plane.

In another embodiment, the radiator patch is affixed to the substrate so that the air gap occupies the entire dielectric space between the ground plane and the radiator patch.

In yet another embodiment, the support means is located a predetermined distance from the radiator patch to improve antenna efficiency.

The present invention also provides a method for constructing a low dielectric loss microstrip antenna that comprises the steps of providing both a radiator layer with a radiator patch located on one face of a substrate and a ground plane in which one of the radiator layer and ground plane have a support structure formed integrally therewith; and bonding the ground plane and the radiator layer in operative proximity to form an air gap of predetermined thickness between the radiator patch and the ground plane.

In another embodiment of the method of construction, the support structure is formed integrally with the ground plane or radiator layer by punching the ground plane or radiator layer with a die to form a plurality of stand-offs having a substantially uniform predetermined height.

In yet a further embodiment of the method of construction, the ground plane and/or radiator layer is a molded part with an integrally formed support structure.

These and other features of the present invention will become evident from the detailed description set forth hereafter with reference to the accompanying drawings.

BRIEF DESCRIPTION OF THE DRAWINGS

A more complete understanding of the invention can be had by referring to the detailed description of the invention and the drawings in which.

DETAILED DESCRIPTION OF THE INVENTION

A detailed description of a microstrip antenna and, in particular, an inverted microstrip antenna structure having an air gap between a radiator patch and a ground plane, and a method of construction for such an antenna, is set forth below with reference to the figures.

Figure 1A:
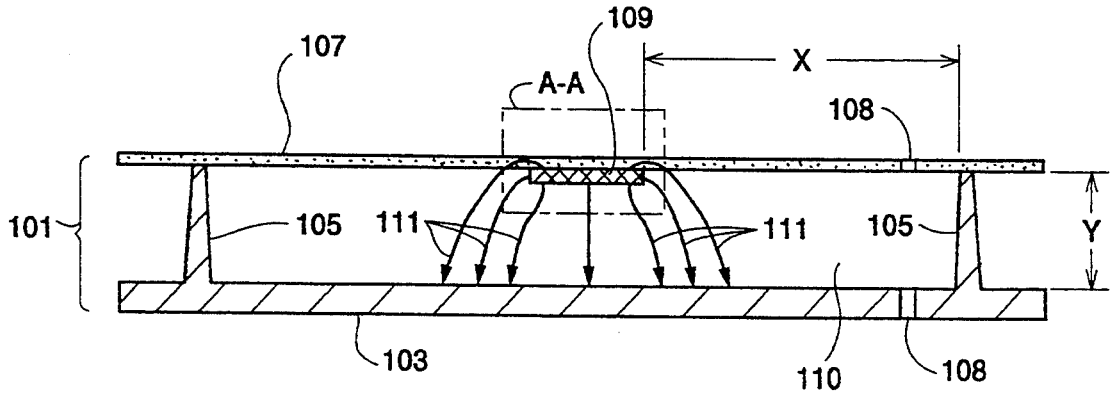
FIG. 1A is a side view of the inverted microstrip antenna structure according to one embodiment of the present invention.

Referring to FIG. 1A, an inverted microstrip antenna structure is indicated generally at 101. In its simplest form, a microstrip antenna comprises a radiator patch that is separated from a ground plane by a dielectric space.

In the embodiment of the present invention illustrated in FIG. 1A, the inverted microstrip antenna 101 comprises a radiator layer 106 that includes a thin substrate layer 107 made of a dielectric material—for example, the epoxy-fiberglass dielectric material sold under the trademark FR-4 (previously G-10)—having suitable dielectric and rigidity properties. Affixed to a bottom face of the substrate layer 107 is a radiator patch 109, made of electrically conductive material. The radiator patch 109 can be made by appropriate etching of the thin substrate layer 107 which has one or both faces entirely coated with the conductive material. Alternatively, the radiator patch may be affixed by one of several available means; for example, an elastic adhesive or glue may be applied to the surface area formed by the contact of the substrate layer 107 and the radiator patch 109 to hold the radiator patch 109 securely in place.

As an alternative to etching and affixing, the radiator patch 109 may be formed directly on the substrate layer 107 using one of several different methods including mirror metallizing techniques, decal transfer techniques, silk screening, or other printed circuit techniques.

Supporting the radiator layer 106 is a ground plane 103 made of electrically conductive material having a plurality of integral support posts or dimples 105 extending substantially perpendicularly from one face of the ground plane 103. In an alternative embodiment, the support posts 105 may be integral with the radiator layer 106 and extend substantially perpendicularly from one face thereof to contact the ground plane 103. In yet another alternative embodiment, a portion of the support posts 105 can be integral with the ground plane 103, while the remainder can be integral with the radiator layer 106. In yet another embodiment, the support posts 105 are formed such that one or more of the posts are comprised of a first portion that is integral with the ground plane 103 and a mating second portion is integral with the radiator layer 106. In any case, the support posts 105 support the radiator layer 106 to maintain a substantially uniform air gap 110 of a predetermined thickness between the radiator patch 109 and the ground plane 103. Further, if needed, a single support post with, for example, an annular shape, can also be utilized.

The sides of the inverted microstrip antenna 101 are not covered and, as a consequence, leave the space between the ground plane 103 and the radiator layer 106 exposed to the external environment. This can serve, at least in terrestrial applications, to reduce side wind loading and promote the drainage or evaporation of moisture located in the space. Similarly, one or more holes 108 can be established in the ground plane 103 and/or radiator layer 106 to reduce frontal and back wind loading on the antenna 101 or promote evaporation or drainage of moisture. Any holes 108 established in the ground plane 103 should be located and of a dimension that avoids producing a resonant structure with the radiator patch 109 that substantially reduces the directional efficiency of the antenna 101.

Figure 1B:
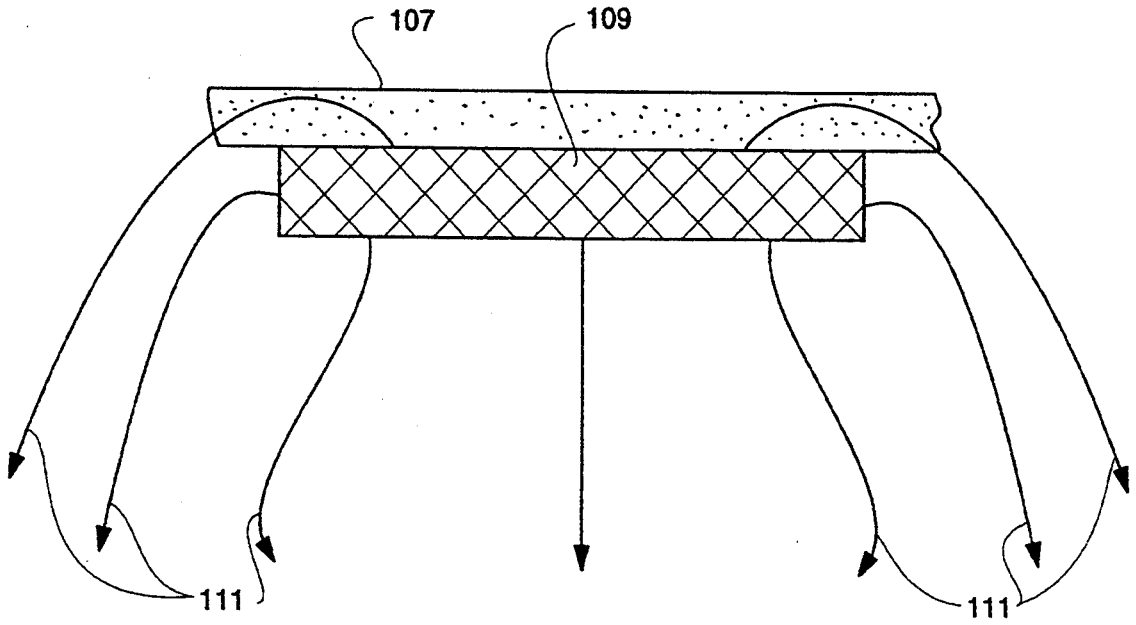
FIG. 1B is an enlarged side view of the Region A-A indicated in FIG. 1A.

As illustrated in FIG. 1A, an electric field 111, indicated by electric field lines, exists between the radiator patch 109 and the ground plane 103. Referring to FIG. 1B, an enlarged view of the section A—A in FIG. 1A, it can be seen that although the predominate share of the electric field 111 exists within the air gap 110, a certain percentage of the electric field 111 is present within the substrate layer 107. In the particular embodiment of the present invention, approximately 10% of the electric field 111 exists within the substrate layer 107, while the other 90% exists within the air gap 110.

The presence of 10% of the electric field 111 in the substrate material 107 slightly increases the overall effective dielectric constant, $\epsilon_{eff}$, of the inverted microstrip antenna structure. Using standard dielectric mixture rules, the effective dielectric constant, $\epsilon_{eff}$, is calculated according to the following equation:

$$\frac{1}{\epsilon_{eff}} = \frac{P_1}{\epsilon_{air}} + \frac{P_2}{\epsilon_r} \qquad \text{(ii)}$$

where $\epsilon_{air}$ is 1; $\epsilon_r$ is the relative dielectric constant of the material used for the substrate layer 107; and $P_1$ and $P_2$ are fractions corresponding to the relative thicknesses of the air gap 110 and the substrate layer 107, respectively. With 90% of the electric field 111 in the air gap 110 and the remaining 10% of the electric field 111 in the substrate layer 107, $P_1$ equal to .9, and $P_2$ equal to .1, and equation (ii) becomes:

$$\epsilon_{eff} = \frac{\epsilon_r}{.9\epsilon_r + .1} \qquad \text{(iii)}$$

Figure 3:
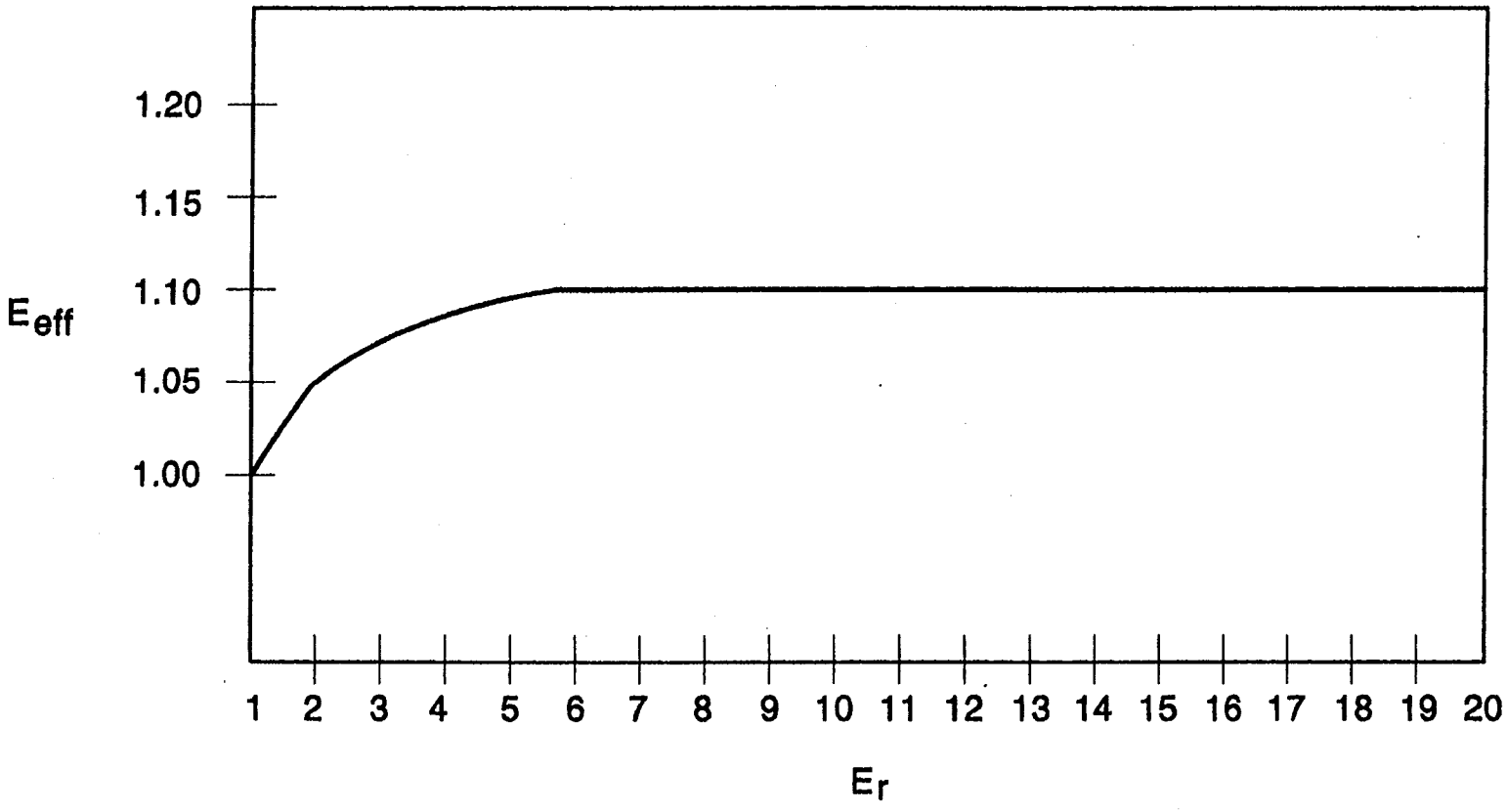
FIG. 3 is a graph illustrating the value of $\epsilon_{eff}$ as the value of $\epsilon_r$ increases.

A graph of equation (iii) is illustrated in FIG. 3 for values of $\epsilon_r$ between 1 and 20, inclusive. As shown in FIG. 3, as the value of $\epsilon_r$ increases from 1 to 5 the value of $\epsilon_{eff}$ also increases slightly from unity to approximately 1.09. As $\epsilon_r$ increases further, however, the value of $\epsilon_{eff}$ increases very little, with an effective limit of 1.11, even when $\epsilon_r$ is as great as 10,000. The overall effective dielectric constant, $\epsilon_{eff}$, of the inverted microstrip antenna according to one embodiment of the present invention, therefore, is highly insensitive to the value of relative dielectric constant, $\epsilon_r$, of the material used for the substrate layer 107. Even when an material having a high relative dielectric constant is used for the substrate layer 107, the inverted antenna structure 101 of the present invention will have a very low $\epsilon_{eff}$ in the range between 1.00 and 1.11. Consequently, because the effective dielectric constant, $\epsilon_{eff}$, is close to one, dielectric loss is low, if not effectively eliminated.

Because the inverted microstrip antenna structure 101 of the present invention has a low $\epsilon_{eff}$ regardless of the value of $\epsilon_r$ used for the substrate layer 107, a high-efficiency, low power-loss microstrip antenna can be constructed using a material which is both inexpensive and easy to work with, for example, the dielectric material sold under the trademark MYLAR or FR-4, for the substrate layer 107. Therefore, the overall cost of antenna system is significantly reduced while a high efficiency rating is maintained.

Referring again to FIG. 1A, the height of the support posts 105 and equivalently the thickness of the air gap is represented in as Y. The value of Y is set according to the operating frequency of the microstrip antenna system. The support posts 105 can be manufactured to be less than 4 millimeters in height, and can be made as small as 0.1 millimeters. As a general rule, the value of Y is inversely proportional to the operating frequency. For example, if an operating frequency in the range of 10 Gigahertz (GHz) is used, Y is set substantially equal to 1 millimeter (mm); if an operating frequency in the range of 40 GHz is used, Y is set substantially equal to 0.1 mm.

As shown in FIG. 1A, the distance between each of the support posts 105 and the radiator patch 109 is represented as X. The value of X is chosen based on two competing factors: (1) X must be small enough, given the rigidity of the material used for radiator layer 106, to provide support for the radiator layer 106 sufficient to prevent excessive sagging or flexure, thereby maintaining a substantially uniform air gap between the radiator patch 109 and the ground plane 103; and (2) X must be large enough so that the support posts 105 are separated a sufficient distance from the radiator patch 109 such that the effect of support posts 105 on the electric field 111 present between the radiator patch 109 and the ground plane 103 is negligible. In one embodiment of the invention, therefore, Y is chosen according to the operating frequency of the antenna system and X is chosen to be approximately 3Y. It has been determined that these proportions provide adequate support for the radiator layer 106 while substantially avoiding signal interference by the support posts 105. Depending upon the rigidity of the material used for the radiator layer 106 and the operating frequency of the microstrip antenna system, different proportions may be used in alternative embodiments.

One embodiment of the inverted microstrip antenna 101 illustrated in FIG. 1A is designed to operate in the Ku band that extends from approximately 11 GHz to 14 GHz. In this embodiment, the inverted microstrip antenna 101 has a surface area dimension in the range of 1'×1' to 2'×2' or, if in a circular shape, a diameter in the range of 1' to 2'. Further, the spacing between the ground plane 103 and the radiator layer 106 is approximately 1 mm or 0.04".

Figure 2:
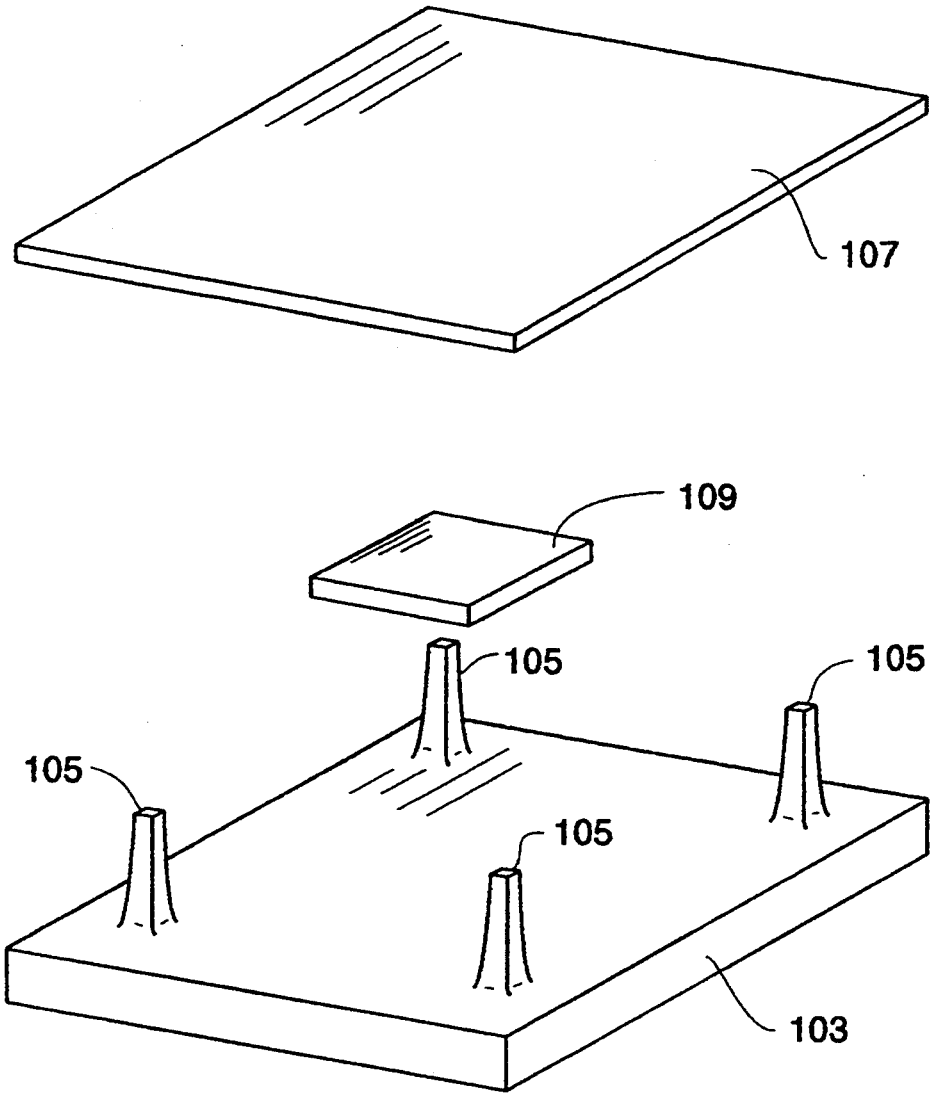
FIG. 2 is an exploded perspective view of the inverted microstrip antenna structure shown in FIG. 1A.

Referring to FIG. 2, an exploded perspective view of the inverted microstrip antenna structure 101 of the present invention is illustrated. Although the inverted microstrip antenna shown in FIG. 2 embodies a single radiator patch 109 and four support posts 105, other embodiments are possible which utilize a plurality of radiator patches, adequately spaced to prevent signal interference, and a number of support posts sufficient to support the radiator layer 106, thereby maintaining a substantially uniform air gap between the ground plane 103 and the plurality of radiator patches.

As mentioned above, the radiator patch of a microstrip antenna receives a signal input from a transmission line, or feedline. Typically, the feedline input is received from a source external to the antenna by means of an input connector. Three different connector embodiments compatible with the inverted microstrip antenna structure of the present invention are described in detail below with reference to FIGS. 4A through 6B.

Figure 4A:
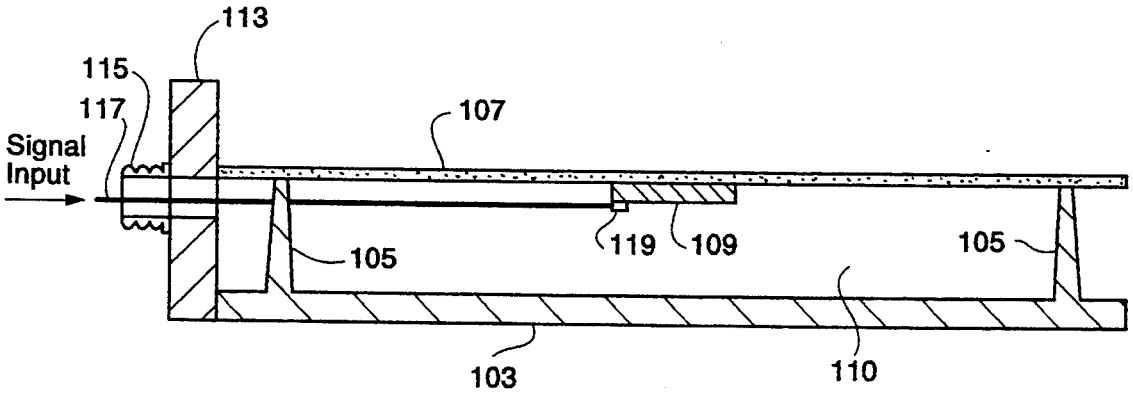
FIG. 4A is side view showing a first feed line connector configuration of the inverted antenna structure according to one embodiment of the present invention.
Figure 4B:
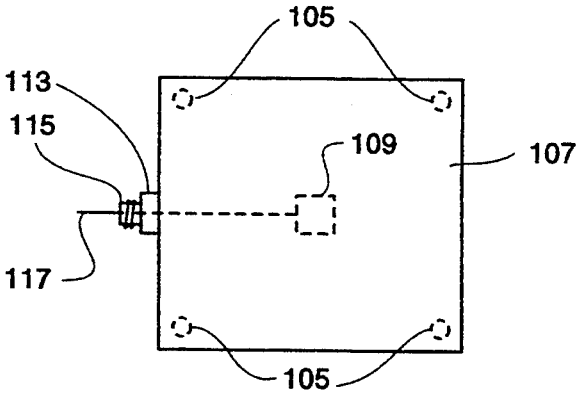
FIG. 4B is a top view of the embodiment illustrated in FIG. 4A;.

Referring to FIGS. 4A and 4B, one embodiment of the present invention utilizing a reverse edge-launch connector is illustrated. The connector assembly comprises a ground block 113, a connector housing 115, and a feed pin 117. The connector housing 115 is electrically connected to the ground block 113 which is, in turn, electrically connected to the ground plane 103 of the inverted microstrip antenna structure 101. The signal input is carried by the feed pin 117 to the radiator patch 109 through an ohmic contact formed therebetween by the solder joint 119. In the reverse edge-launch embodiment the connector is positioned along one edge of the inverted microstrip antenna structure 101. It is designated as a reverse connection because the feed pin 117 is connected to the radiator patch 109, for example, by a solder joint 119, within the air gap region 110.

Figure 5A:
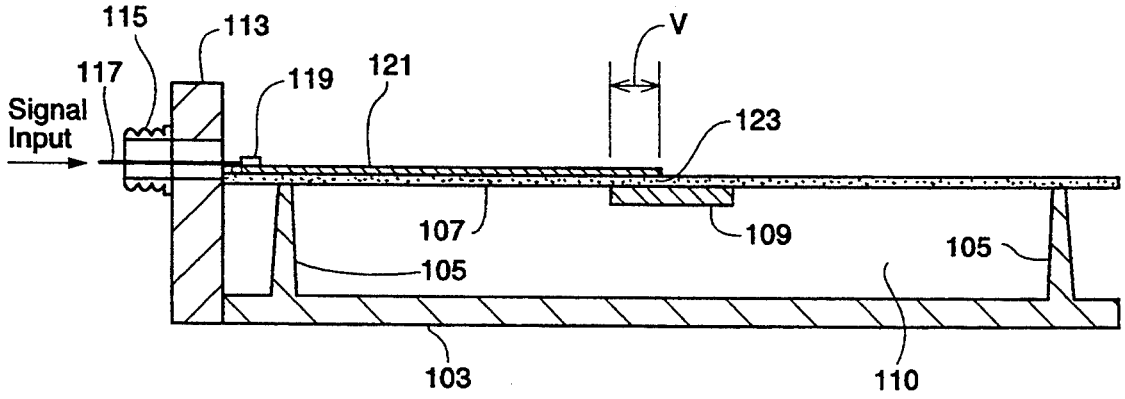
FIG. 5A is a side view showing a second feed line connector configuration of the inverted microstrip antenna structure according to another embodiment of the present invention.
Figure 5B:
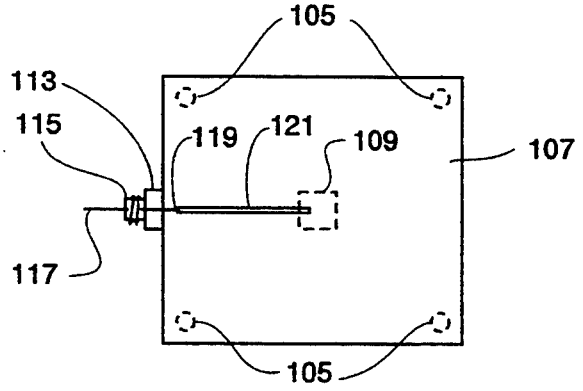
FIG. 5B is a top view of the embodiment illustrated in FIG. 5A.

Referring to FIGS. 5A and 5B, another embodiment of the present invention utilizing an edge-launch connector is illustrated therein. In this embodiment, the connector assembly similarly comprises a ground block 113 electrically connected to the ground plane 103, a connector housing 115, and a feed pin 117. In contrast to the reverse edge-launch connector, however, the feed pin 117 in the standard edge-launch embodiment is disposed atop the substrate layer 107, and is connected, for example, by means of a solder joint 119, to a line feed element 121. The line feed element 121 is affixed to a top face of the radiator layer 106 and overlaps the radiator patch 109 by a predetermined amount, V, to form an overlap region 123. (To avoid the solder joint 119 and the possible affixation of the line feed element 121 to the top face of the radiator 106, a connector assembly with a feed pin 117 that extends a sufficient distance beyond the end of the ground block 113 to capacitively couple to the radiator patch 109 can be used.) In this configuration, the signal input is carried by the feed pin 117, through the line feed element 121, and to the radiator patch 109 by means of a capacitively coupled electrical connection that exists between the line feed element 121 and the radiator patch 109. If certain requirements are satisfied, as discussed below, the capacitively coupled electrical connection performs comparably to an ohmic electrical connection. Moreover, because the edge-launch connector configuration does not require any connections within the air gap 110, the standard edge-launch connector can be connected after the radiator layer 106 is joined to the support posts 105.

In the embodiment of the present invention shown in FIGS. 5A and 5B, the characteristics of the capacitively coupled electrical connection are determined by several parameters. Initially, when operating at higher frequencies, such as in the RF range, it is important that the interconnections between circuit elements be impedance matched to minimize signal reflections and maximize power transfer. One method to achieve an impedance matched connection is to create an overlap length of $\lambda/4$ between the two sets of circuitry. As shown in FIG. 5A, when the overlap length, V, is set substantially equal to $\lambda/4$, an impedance matched electrical connection is thereby established. Alternatively, the overlap length, V, may be equal to a length other than $\lambda/4$ as long as the overlapped surface area establishes sufficient capacitive coupling between the line feed element 121 and the radiator patch 109. For example, an overlap length other than $\lambda/4$ may be desirable for systems which operate over a broad band of frequencies.

The capacitance of the connection, C, is determined by the equation:

$$C=\epsilon_r A/d \qquad \text{(iv)}$$

where $\epsilon_r$ is the relative dielectric constant of the material used for the substrate layer 107, A is a surface area of the overlapped region, and d is a separation distance between the line feed element 121 and the radiator patch 109, which corresponds to the thickness of the substrate layer 107. The impedance of the connection, Z, is determined by the equation:

$$Z=-j/\omega C \qquad \text{(v)}$$

where $-j$ is equal to the square-root of $-1$, $\omega$ is equal to $2\pi$ times the operating frequency, and C is the capacitance of the connection, calculated according to equation (iv), above. When appropriate values of $\epsilon_r$, A, and d are used, the capacitance, C, is great enough so that the impedance, Z, of the connection becomes negligible and the connection effectively appears as a short-circuit to RF signals.

Figure 6A:
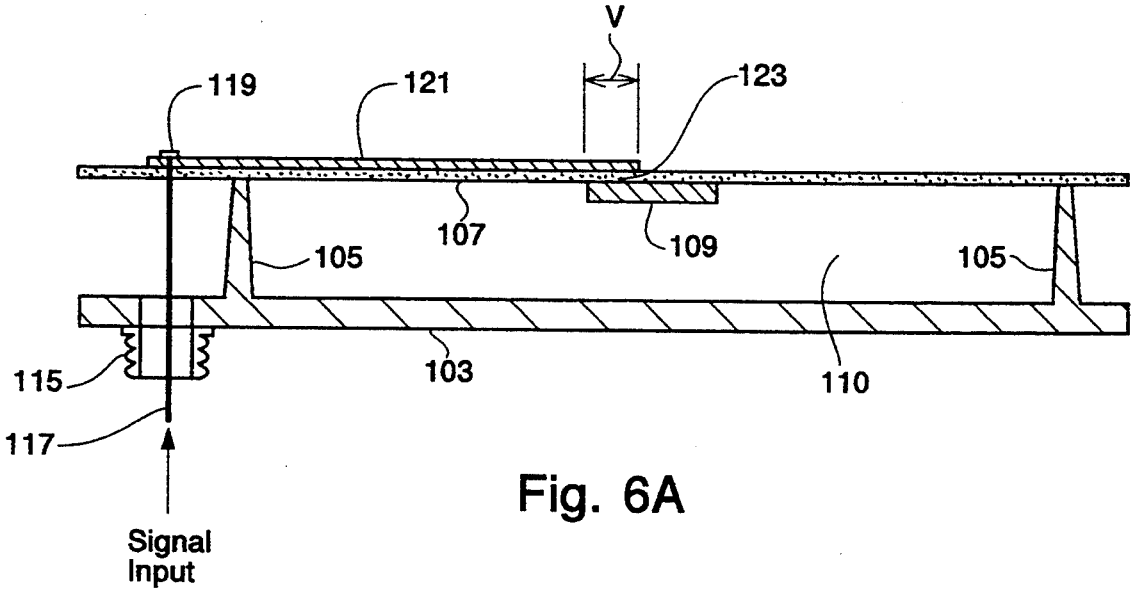
FIG. 6A is a side view showing a third feed line connector configuration of the inverted microstrip antenna structure according to another embodiment of the present invention.
Figure 6B:
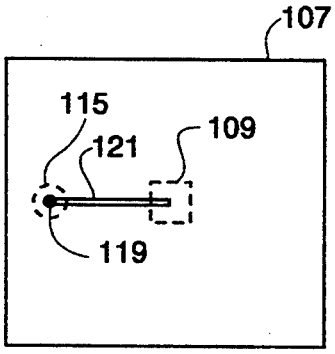
FIG. 6B is a top view of the embodiment illustrated in FIG. 6A.

Referring to FIGS. 6A and 6B, another embodiment of the present invention utilizing a back-launch connector is illustrated therein. In this embodiment, the connector assembly comprises a connector housing 115 electrically connected to the ground plane 103, and a feed pin 117 which passes through each of the air gap 110 and the substrate layer 107 to connect, for example, by means of a solder joint 119, to a line feed element 121. As discussed above, the line feed element 121 maintains a capacitively coupled electrical connection with the radiator patch 109 for providing the signal input thereto. As with the edge-launch connector, the back-launch connector can be connected after the inverted microstrip antenna structure 101 has already been assembled. In contrast both to the reverse and the edge-launch connector embodiments, however, the back-launch connector is connected directly to a bottom face of the ground plane 103. This configuration has the advantages of, inter alia, further simplifying the construction of the antenna system by reducing the number of components needed to establish the connection.

Figure 6C:
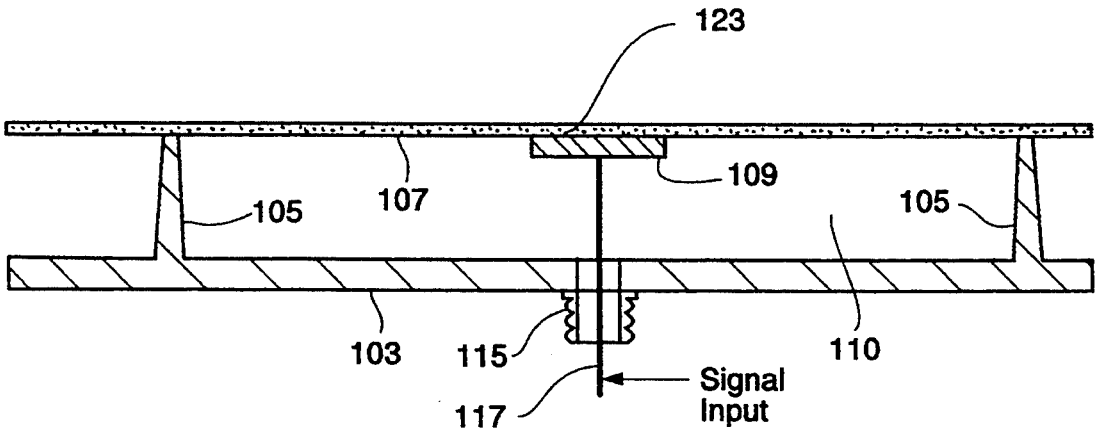
FIG. 6C illustrates a direct back-launch connector.

In an alternative embodiment that is illustrated in FIG. 6C, a back-launch connector can be positioned directly under the radiator patch 109 so that a direct ohmic connection can be established between the feed pin 117 and the radiator patch 109 within the air gap 110, thereby eliminating the need for line feed element 121.

Figure 7A:
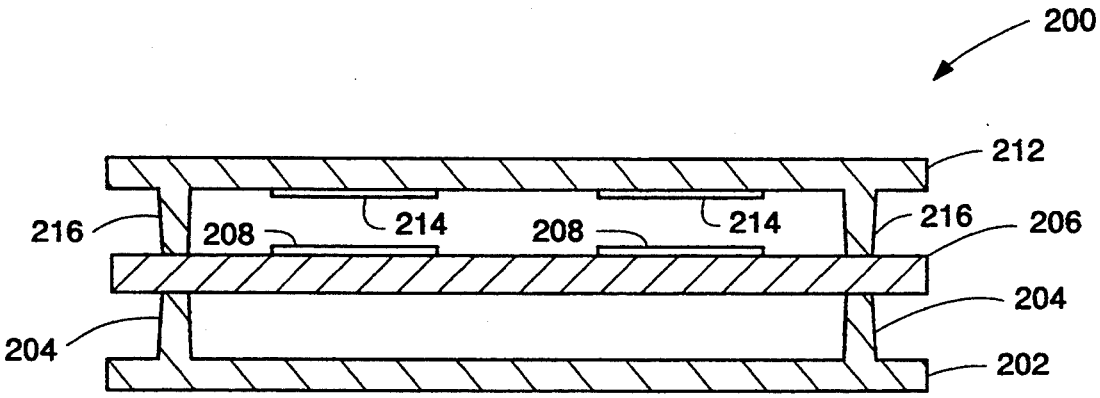
FIGS. 7A–7C illustrate a multi-layer embodiment of the invention that provides improved bandwidth.
Figure 7B:
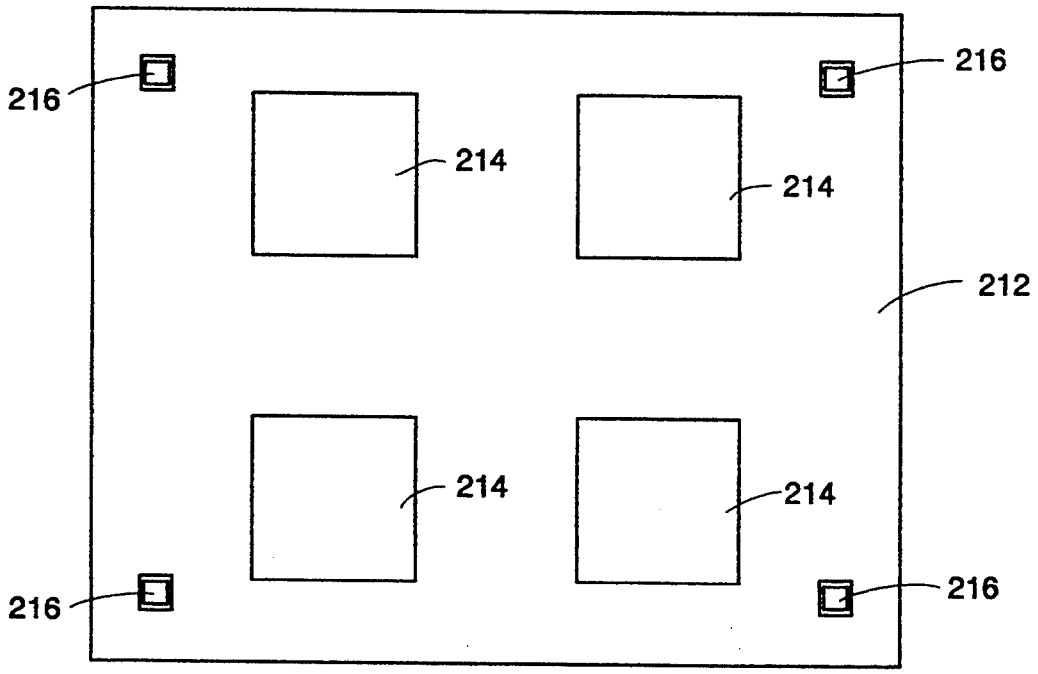
Figure 7C:
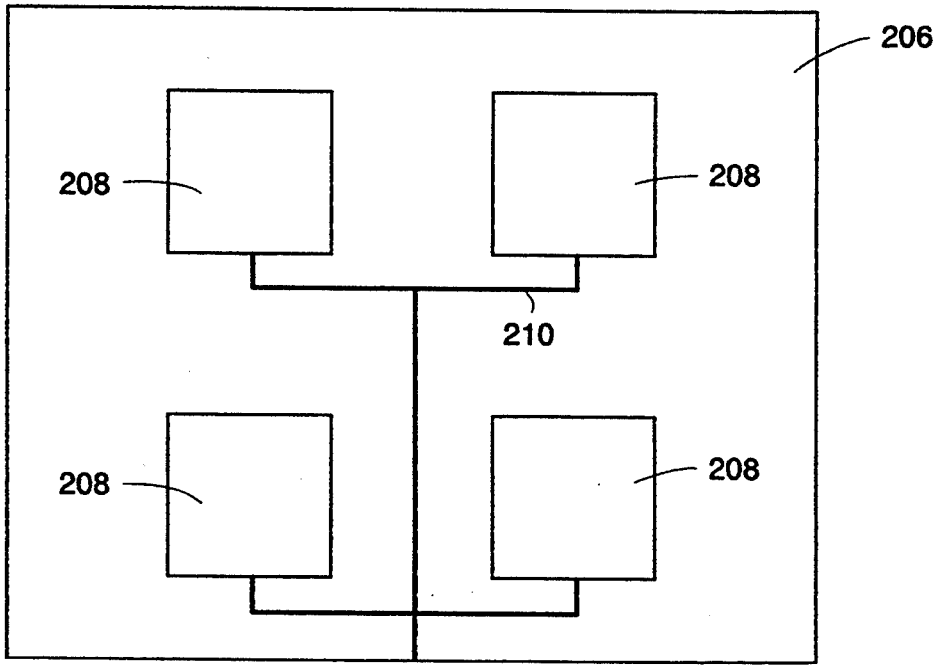

With reference to FIGS. 7A–7C, a multi-layer microstrip antenna 200 that provides improved bandwidth and employs integral support structures is illustrated. The antenna 200 includes a ground plane 202 with a first set of integral support posts 204. The antenna 200 also includes a driver layer 206 with driver elements 208 that are connected to a feed line structure 210 that provides the ability to communicate signals to and from the driver elements 208. A driven layer 212 is also included in the antenna 200. The driven layer 212 includes a plurality of driven elements 214 that, when the antenna is in operation, are each capacitively coupled to the corresponding ones of the driver elements 208 and, as such, provide a broader bandwidth. Also part of the driven layer 212 are a second set of integral support posts 216. The first set of integral support posts 204 and second set of integral support posts 206 cooperate to maintain the appropriate spacing between the ground plane 202, driver layer 206 and driven layer 212.

Referring now to FIGS. 8A through 8E, a relatively easy and inexpensive method of constructing an inverted microstrip antenna structure is provided as follows.

Figure 8A:
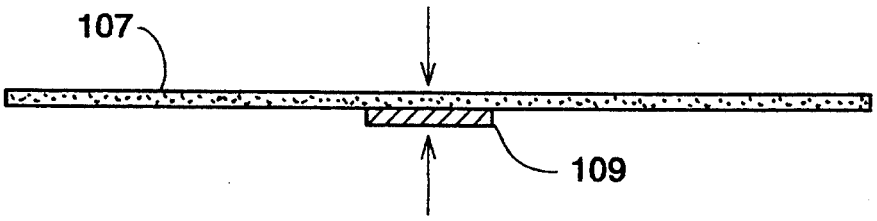
FIGS. 8A–8E are side views showing the steps in constructing the inverted microstrip antenna structure according to one embodiment of the present invention.

In FIG. 8A, a radiator patch 109, composed of a suitable electrically conductive material, for example, copper or silver, is affixed to a thin, planar substrate layer 107, composed of a dielectric material having sufficient rigidity characteristics, for example, the dielectric material sold under the trademark MYLAR or FR-4. The affixing step may be accomplished, for example, by means of an elastic adhesive or glue having suitable bonding and dielectric characteristics.

As discussed previously, because the overall $\epsilon_{eff}$ of the inverted antenna structure of the embodiment of the present invention illustrated in FIG. 8A is relatively insensitive to the $\epsilon_r$ value of the material used for the substrate layer 107, it is generally unnecessary that either the substrate layer 107 or the glue used to affix the radiator patch 109 be composed of a material having a low $\epsilon_r$ to obtain a high efficiency and low dielectric loss antenna system. Therefore, inexpensive materials may be used as convenient for each of the substrate layer 107 and the affixing adhesive.

As an alternative to affixing, the radiator patch 109 may be formed directly on the substrate layer 107 using one of several different methods including mirror metallizing techniques, decal transfer techniques, silk screening, etching or other printed circuit techniques.

Although in the particular embodiment shown in FIG. 8A the radiator patch 109 is located on the lower surface of the substrate layer 107, in an alternative embodiment, the radiator patch 109 can be located on the top surface of the substrate layer 107 such that the substrate layer 107 is arranged between the radiator patch 109 and the ground plane 103. This alternative embodiment may be used for, inter alia, obtaining a specific effective dielectric constant value, $\epsilon_{eff}$, by varying the respective thicknesses of the substrate layer 107 and the air gap 110, thereby mixing their relative dielectric constants in predetermined proportions to arrive at a desired $\epsilon_{eff}$, as defined by equation (ii), above.

Figure 8B:
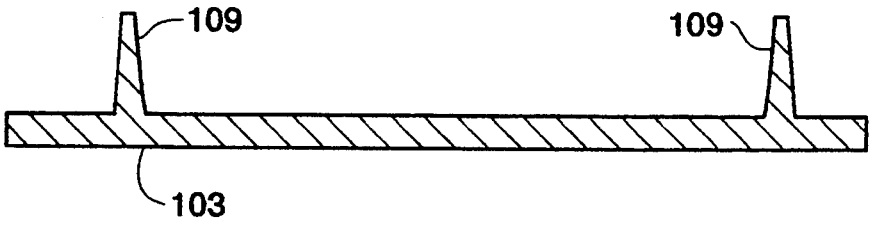

In FIG. 8B, a ground plane 103 is formed from a suitable electrically conductive material, for example, copper or silver. Integral with the ground plane 103, a plurality of stand-offs or support posts 105 are formed, for example, by punching the bottom face of the ground plane 103 with a die thereby deforming the ground plane 103 and resulting in a plurality of protrusions of ground plane material. The ground plane 103 with its support posts 105 can also be formed by one of several different methods including casting, extruding, etc. One such method is to form the ground plane 103 by appropriately molding a plastic or other polymer to form a frame with the support posts and then metallize the frame to establish the ground surface. Moreover, in an alternative embodiment, the support posts can be formed as integral components of the radiator layer 106 rather than the ground plane 103, or distributed between the ground plane 103 and the radiator layer 106, or as a single support structure.

In the particular embodiment depicted in FIG. 8B, all the support posts 105 are formed to a substantially uniform height by a die.

Figure 8C:
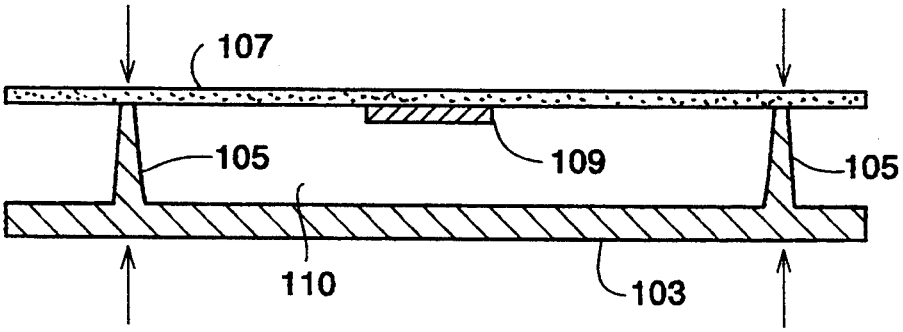

In FIG. 8C, the substrate layer 107 is joined to the support posts 105 to form a microstrip antenna structure having a substantially uniform air gap 110 between the radiator patch 109 and the ground plane 103. The substrate layer 107 may be joined to the support posts 105 by any one of several different bonding means including elastic adhesive, clamps, screws, springs, or a support frame.

Figure 8D:
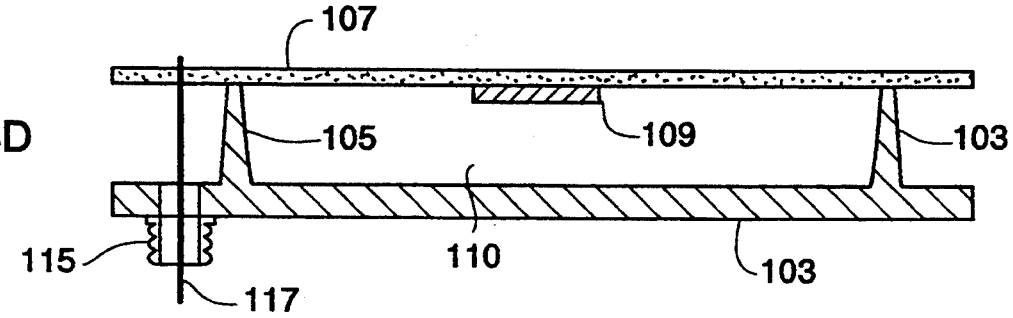
Figure 8E:
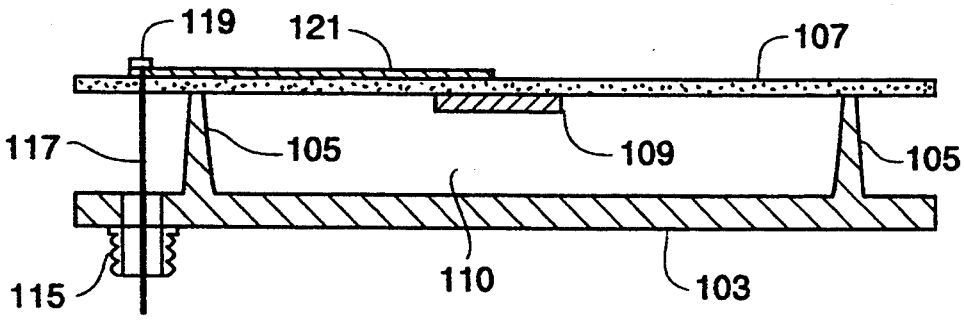

In FIGS. 8D and 8E, following completion of the inverted microstrip antenna structure, a back-launch connector is connected as follows. Initially, in FIG. 8D, the connector housing 115 is electrically connected to the ground plane 103. Next, the feed pin 117 is passed through the connector and penetrates the substrate layer 107 without contacting the ground plane 103.

In FIG. 8E, a tip of the feed pin 117 penetrating the substrate layer 107 is electrically connected, for example, by a solder joint 119 to a line feed element 121. The line feed element 121 is disposed along a top surface of the substrate layer 107 and is arranged to overlap the radiator patch 109 by a predetermined amount to form a capacitively coupled connection therebetween.

Typically, the line feed element 121 is established on the substrate layer 107 at the same time as the radiator patch 109. However, it can also be established during later steps of the construction process, if needed.

Although the above-described method utilizes a back-launch connector, another type of connector, for example, an edge-launch or a reverse edge-launch connector can be utilized, if so desired.

The foregoing description of the invention has been presented for purposes of illustration and description. Further, the description is not intended to limit the invention to the form disclosed herein. Consequently, variations and modifications commensurate with the above teachings, and the skill or knowledge in the relevant art are within the scope of the present invention. The preferred embodiment described herein above is further intended to explain the best mode known of practicing the invention and to enable others skilled in the art to utilize the invention in various embodiments and with various modifications required by their particular applications or uses of the invention. It is intended that the appended claims be construed to include alternate embodiments to the extent permitted by the prior art.

What is claimed is:

1. A microstrip antenna comprising:

a substantially rigid radiator layer that includes a substrate layer and a radiator patch disposed on one of a lower surface and an upper surface of said substrate layer;

a ground plane that is located adjacent to only said lower surface of said substrate layer, wherein said upper surface of said substrate layer is substantially free of any portion of said ground plane positioned adjacent thereto; and a plurality of support means, each made from the same piece of material as at least one of said ground plane and said radiator layer, for maintaining a dielectric space between said radiator patch and said ground plane that includes an air gap, wherein each of said plurality of support means maintains a predetermined distance between said radiator patch and said ground plane, wherein each of said plurality of support means has a dimple shape that, if a cross-section is taken which is substantially between and substantially parallel to said radiator layer and said ground plane, has a closed surface, wherein each of said plurality of support means has a base that is surrounded by said ground plane or said radiator layer, and wherein each of said plurality of support means has substantially the same dimple shape.

2. A microstrip antenna according to claim 1, wherein:

said radiator patch is disposed on a bottom surface of said substrate layer, such that said radiator patch is positioned between said substrate layer and said ground plane.

3. A microstrip antenna according to claim 1 wherein:

said radiator patch is disposed on a bottom surface of said substrate layer such that said radiator patch is positioned between said substrate layer and said ground plane, and said air gap extends from said radiator patch to said ground plane.

4. A microstrip antenna according to claim 1, wherein:

each of said plurality of support means is arranged to avoid interposition between said radiator patch and said ground plane.

5. A microstrip antenna according to claim 1, wherein:

said radiator patch and said ground plane are separated by a distance substantially equal to H, and wherein said distance between each of said plurality of support means and said radiator patch is substantially equal to W, wherein W is at least approximately three times larger than H.

6. A microstrip antenna according to claim 1 wherein:

at least one of said plurality of support means includes a first portion that is made from the same piece of material as said radiator layer and a second portion that is made from the same piece of material as said ground plane.

7. A microstrip antenna according to claim 1, wherein:

said plurality of support means each serve to maintain a distance between said radiator patch and said ground plane that is less than about 0.5 millimeters so that high frequency operation can be achieved.

8. A microstrip antenna according to claim 1, wherein:

at least one of said substrate layer and said ground plane include a perforation of predetermined size to allow air and water to pass between said air gap and an exterior environment.

9. A microstrip antenna according to claim 1, wherein:

the air gap is open to the ambient atmosphere.

10. A microstrip antenna according to claim 1, further comprising:

a connector for conveying a signal to said radiator patch, wherein said connector includes a feed element that overlaps said radiator patch and a dielectric material that is located between said feed element and said radiator patch thereby forming a capacitively coupled connection between said feed element and said radiator patch.

11. A microstrip antenna according to claim 1, further comprising:

one of the following: a back-launch connector, an edge-launch connector, and a reverse angle edge launch connector that is operatively attached to said radiator patch and said ground plane.

12. A microstrip antenna according to claim 1, wherein:

said substantially rigid radiator layer is substantially planar and each of said plurality of support means is made from the same piece of material as said ground plane.

13. A microstrip antenna according to claim 1, wherein:

said predetermined distance is fixed.

14. A microstrip antenna according to claim 1, wherein:

said plurality of support means includes at least three support means.

15. A microstrip antenna according to claim 1, wherein:

said said substantially rigid radiator layer extends to a first circumferential edge and said ground plane extends to a second circumferential edge;

wherein at least one of said plurality of support means is located interior to both said first and second circumferential edges.

16. A microstrip antenna according to claim 1, wherein:

said substantially rigid radiator layer includes a plurality of said radiator patch;

wherein at least three of said plurality of support means are located around each of said plurality of said radiator patch.

17. A microstrip antenna according to claim 1, wherein:

at least one of said plurality of support means includes a contact surface for contacting each of said ground plane and said radiator layer, wherein said contact surface is oriented other than perpendicular to said radiator layer and said ground plane.

18. A microstrip antenna according to claim 1, wherein:

said substantially rigid radiator layer includes a driver layer with a driver element;

each of said plurality of support means is made from the same piece of material as both said substrate layer of said substantially rigid radiator layer and said ground plane; and said driver layer is supported between said substrate layer and said ground plane.

19. A microstrip antenna comprising:

a substantially rigid radiator layer that includes a substrate layer and a radiator patch which is disposed on one of a lower surface and an upper surface of said substrate layer;

a ground plane that is located adjacent to only said lower surface of said substrate layer, wherein said upper surface of said substrate layer is substantially free of any portion of said ground plane positioned adjacent thereto; and a plurality of support means, each of said plurality of support means made from the same material as at least one of said ground plane and said radiator layer, for maintaining a dielectric space between said radiator patch and said ground plane that includes an air gap and that has a predetermined distance between said radiator patch and said ground plane;

wherein at least one of said substrate layer and said ground plane forms at least a portion of an exterior surface that is exposed to the environment and includes a perforation to allow at least one of the following: air and water to pass between said air gap and an ambient environment exterior to said substantially rigid radiator layer and said ground plane.

20. A microstrip antenna according to claim 19, wherein:

said substrate layer and said ground plane each include a perforation to allow at least one of the following: air and water to pass therethrough.

21. A microstrip antenna according to claim 19, wherein: said air gap is open to the ambient atmosphere.

22. A method of constructing a microstrip antenna comprising the steps of:

providing a substantially rigid radiator layer that includes a substrate layer and a radiator patch that is located on one of a lower surface and an upper surface of said substrate layer, and a ground plane, wherein at least one of said radiator layer and said ground plane includes a plurality of support means that are each made from the same piece of material as at least one of said radiator layer and said ground plane and serve to maintain a dielectric space between said radiator patch and said ground plane that includes an air gap, wherein each of said plurality of support means maintains a predetermined distance between said radiator patch and said ground plane, and each of said plurality of support means is located a distance from said radiator patch so as to avoid interposition between said radiator patch and said ground plane, wherein each of said plurality of support means has substantially a dimple shape that, if a cross-section is taken which is substantially between and substantially parallel to said radiator layer and said ground plane, has a closed surface, wherein each of said plurality of support means has a base that is surrounded by said ground plane or said radiator layer, and wherein each of said plurality of support means has substantially the same dimple shape; and operatively connecting said radiator layer and said ground plane layer to form a microstrip antenna in which said ground plane is located adjacent to only said lower surface of said substrate layer and said upper surface of said substrate layer is substantially free of any portion of said ground plane positioned adjacent thereto, and an air gap is located between the radiator patch and the ground plane.

23. A method of constructing a microstrip antenna according to claim 22, wherein:

said step of providing comprises punching one of the ground plane layer and the radiator layer with a die to form said support means.

24. A method of constructing a microstrip antenna according to claim 22, wherein:

said step of providing comprises molding one of the ground plane and the radiator layer with said support means.

25. A method of constructing a microstrip antenna according to claim 22, wherein:

said step of providing comprises molding one of the ground plane and the radiator layer with said support means to form a frame and metallizing said frame.

26. A method of constructing a microstrip antenna according to claim 22, wherein:

said step of providing comprises extruding one of the ground plane layer and the radiator layer to form said support means.

27. A method of constructing a microstrip antenna according to claim 22, wherein:

said step of providing comprises casting one of the ground plane and the radiator layer to form said support means.

28. A method of constructing a microstrip antenna according to claim 22, wherein:

said step of operatively connecting includes positioning said radiator layer so that said radiator patch is located between said substrate layer and said ground plane.

29. A method of constructing a microstrip antenna according to claim 22, further comprising the step of:

placing a feed element and a dielectric material such that the feed element overlaps the radiator patch by a predetermined amount and said dielectric material is located between the feed element and the radiator patch thereby forming a capacitively coupled electrical connection between the feed element and the radiator patch.

30. A method of constructing a microstrip antenna according to claim 22, wherein:

said step of providing comprises at least one of said substrate layer and said ground plane including a perforation of predetermined size to allow at least one of the following: air and water to pass therethrough.

* * * * *